United States Patent [19]

Shawen et al.

[11] Patent Number: 4,482,057

[45] Date of Patent: Nov. 13, 1984

[54] RECORD MEDIA DISPENSING APPARATUS

[75] Inventors: Harley J. Shawen, Kettering; Richard P. Marvin, West Carrollton, both of Ohio

[73] Assignee: NCR Corporation, Dayton, Ohio

[21] Appl. No.: 335,916

[22] Filed: Dec. 30, 1981

[51] Int. Cl.[3] ..... B07C 5/00; B65H 43/00

[52] U.S. Cl. ..... 209/534; 271/303

[58] Field of Search ..... 209/534, 603; 194/4 R, 194/4 B, 4 C, 4 D, 4 E, 4 F, 4 G, DIG. 26; 271/9, 301, 302, 303, 314, DIG. 9; 235/379

[56] References Cited

U.S. PATENT DOCUMENTS

| | | | |
|---|---|---|---|
| 2,533,184 | 12/1950 | Trump | 271/302 |
| 3,123,082 | 3/1964 | Call et al. | 194/DIG. 26 |
| 3,442,363 | 5/1969 | Riddle et al. | 194/4 R |
| 3,447,655 | 6/1969 | Tanaka et al. | 194/4 R |
| 3,672,487 | 6/1972 | Schneider | 271/9 X |
| 3,724,657 | 4/1973 | Katagiri et al. | 271/303 X |
| 3,788,333 | 1/1974 | Johnson | 194/DIG. 26 |
| 3,791,392 | 2/1974 | Hanson | 133/1 R |
| 4,017,004 | 4/1977 | Onoe et al. | 271/9 |
| 4,066,253 | 1/1978 | Lundbald et al. | 194/4 R X |
| 4,179,031 | 12/1979 | Ward | 209/534 |
| 4,251,010 | 2/1981 | Schmeykal et al. | 209/534 X |
| 4,363,584 | 12/1982 | Kokubo | 271/9 X |

*Primary Examiner*—David A. Scherbel
*Assistant Examiner*—Edward M. Wacyra
*Attorney, Agent, or Firm*—J. T. Cavender; Albert L. Sessler, Jr.; Elmer Wargo

[57] ABSTRACT

A record media transporting or dispensing mechanism comprising a first moving endless belt system having an advance side and a return side and also having a diversion point therebetween. The mechanism also includes bill cassettes and pickers for supplying record media to the advance side and also for cooperating with the advance side to transfer the record media to the diversion point. Also included is a second moving endless belt system cooperating with the return side to provide an entry area and a discharge area with regard to the record media and also for transporting record media from the entry area to the discharge area. A buncher is used for receiving and accumulating the record media received from the diversion point and a diverter, located at the diversion point, is used for diverting the record media into the entry area or the buncher accumulating in response to a control signal. A control circuit is used for generating the control signal and also for controlling the movement of the record media in the dispensing mechanism in response to predetermined criteria.

10 Claims, 5 Drawing Figures

RECORD MEDIA DISPENSING APPARATUS

BACKGROUND OF THE INVENTION

This invention relates to a record media dispensing apparatus which is especially useful in automated teller machines or teller assist machines, for example, which apparatus dispenses various record media such as notes, currency, and the like.

Various types of dispensing apparatuses are available currently for use in automated teller machines (ATMs); however, there is a constant effort to make such apparatuses cheaper, more compact, and more reliable than those currently available.

SUMMARY OF THE INVENTION

This invention, in a preferred embodiment thereof, relates to a record media dispensing or transporting apparatus which comprises: a first moving endless belt system having an advance side and a return side and also having a diversion point therebetween; means for supplying the record media to the advance side and for cooperating with the advance side to transfer the record media to the diversion point; a second moving endless belt system cooperating with the return side to provide an entry area and a discharge area with regard to the record media and also for transporting record media from the entry area to the discharge area; means for receiving and accumulating the record media received from the diversion point; means located at the diversion point for diverting the record media into the entry area or the receiving and accumulating means in response to a control signal; and control means for generating the control signal and for controlling the movement of the record media in the dispensing mechanism in response to predetermined criteria.

The record media dispensing or transporting apparatus of this invention is compact, reliable and relatively inexpensive to produce.

The apparatus also is versatile in that it can be fitted into relatively compact areas.

These advantages and others will become more readily understood in connection with the following specification, claims and drawing.

DETAILED DESCRIPTION OF THE INVENTION

Figure 1A:
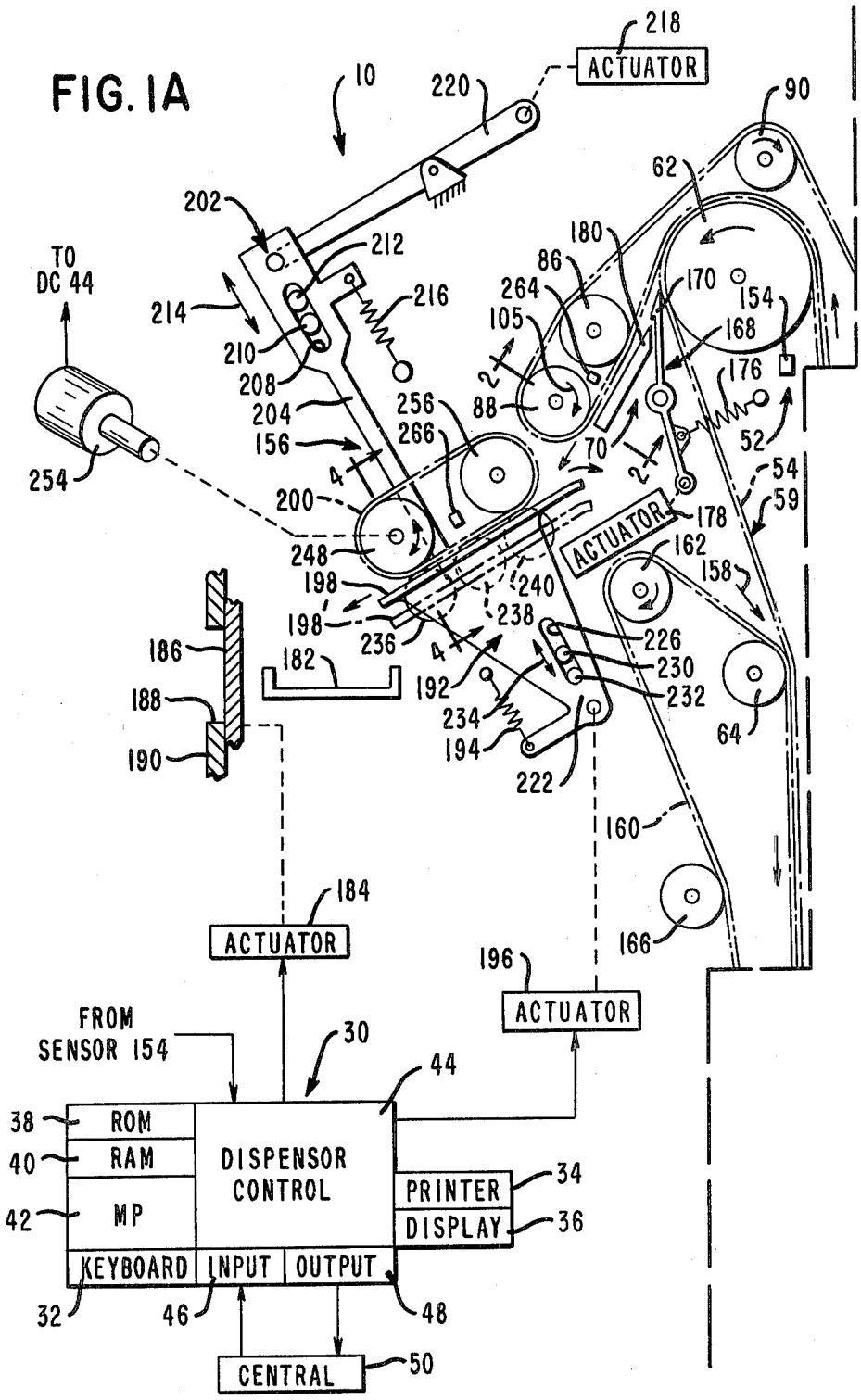
FIGS. 1A and 1B taken together represent a general schematic diagram of the apparatus of this invention, with certain belt systems used therein being shown in a side elevational view.
Figure 1B:
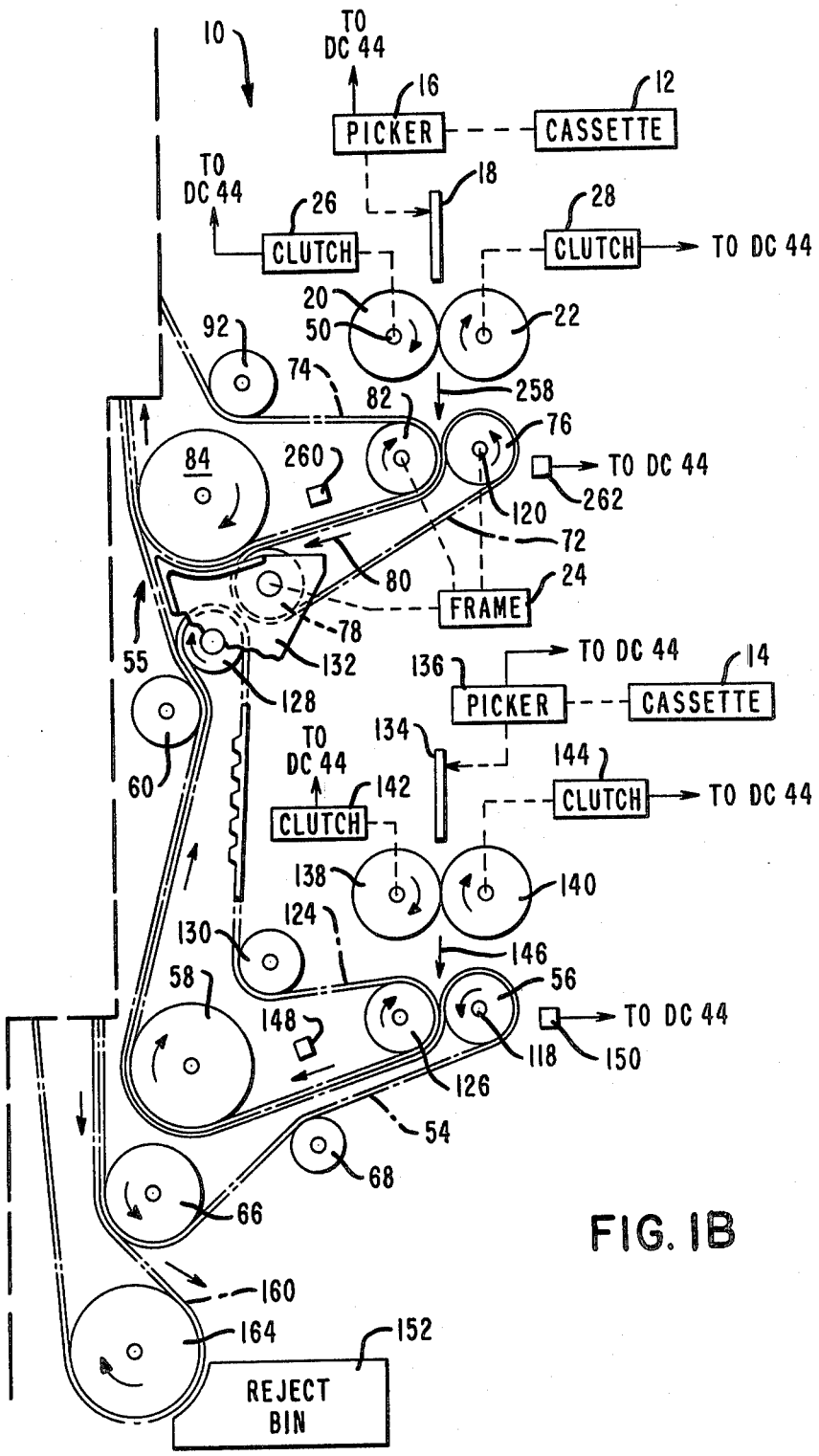

FIGS. 1A and 1B taken together show a schematic representation of a preferred embodiment of the apparatus of this invention, with the apparatus being designated generally as 10. Many of the elements shown therein are shown in diagrammatic form so as to simplify the drawing, and many elements which are conventional are simply shown in block form.

The apparatus 10 may be used in record media handling environments, as for example, in a cash dispensing machine for the dispensing of currency, notes, and the like.

Most cash dispensing or automated teller machines dispense at least two denominations of currency upon request by a customer. For example, if $5.00 and $20.00 bills in U.S. currency are stored in such a machine, the amount of cash requested by a customer would be dispensed in multiples of $5.00 and $20.00 bills and various combinations thereof.

In the embodiment described, the apparatus 10 can dispense two different denominations of bills in response to a customer's request. For example, the cassette 12 (FIG. 1B) may contain $5.00 bills and the cassette 14 may contain $20.00 bills as previously described. As shown in FIG. 1B, the side of the cassette 12 is shown with the bills therein (not shown) being stacked on edge and with the length of the bills extending perpendicularly into the plane of the drawing. The cassette 12 has a picker 16 associated therewith to pick a bill 18 from the cassette 12 and transfer it to the singulating wheels 20 and 22. The picker 16 may be any conventional picking mechanism such as a vacuum transfer arm, for example, which picks the first bill in the stack of bills in the cassette and transfers the bill 18 to the singulating wheels 20 and 22.

The singulating wheels 20 and 22 (FIG. 1B) are rotatably mounted in the frame shown only schematically as a block 24. Wheel 20 is rotated in a clockwise direction, as viewed in FIG. 1B, by a clutch mechanism 26, and wheel 22 is rotated similarly in a clockwise direction by a clutch mechanism 28. Wheel 20 has an elastomeric coating on its periphery; the periphery has a high coefficient of friction, and wheel 22 is similarly constructed, but its coating has a low coefficient of friction. The peripheries of these wheels 20 and 22 are spaced close together to provide a feeding and singulating action therebetween. Wheel 20 tends to drive the bill 18 downwardly as viewed in FIG. 1B while wheel 22 tends to drive it upwardly. Wheel 20 is operatively rotated under the control of the clutch mechanism 26 which is controlled by a dispenser control 44 of the control unit 30 shown in FIG. 1A, and similarly wheel 22 is operatively rotated under the control of the clutch mechanism 28 which is controlled by the dispenser control 44 of control unit 30.

As an aside, the control unit 30 (FIG. 1A) may be conventional, and it includes a keyboard 32 on which a user of the apparatus 10 may enter the usual data, including the monetary amount requested, associated with a valid use of the apparatus 10. The control unit 30 also includes a printer 34, for printing receipts, and a display 36, for communication with the user. The control unit 30 also includes a read only memory (ROM) 38, a random access memory (RAM) 40, a microprocessor (MP) 42 and the dispenser control 44 hereinafter referred to as DC 44. The software including application programs associated with functioning of the apparatus 10 may reside in the ROM 38, for example, and the sequencing of the various operations performed by the apparatus 10 is handled by the control unit 30. The DC 44 also has an input port 46 which provides an input interface between the control unit 30 and a host system or central 50, and similarly, an output port 48 is used to provide an output interface between the control unit 30 and central 50.

As previously stated, the clutch mechanisms 26 and 28 (FIG. 1B) are controlled by the DC 44 of the control unit 30 just described. When clutch mechanism 26 is energized by the DC 44, wheel 20 is rotated as previously explained, and when clutch 28 is energized, wheel 22 is also rotated as previously explained. Should more than one bill 18 be picked off from the cassette 12, the rotation of wheel 22 tends to singulate the bills to permit only one bill at a time to pass therebetween. While only one wheel 20 and one wheel 22 are shown in FIG. 1B, there are actually two additional wheels 20' (not shown) which are spaced along the shaft 50 and secured thereto to contact the length of the bill 18; this same construction is employed for wheel 22. This aspect will become clearer with a discussion of FIG. 2.

The apparatus 10 also includes a first moving endless belt system (hereinafter called first system) which is designated generally as 52 and is shown in FIGS. 1A and 1B. The first system 52 includes an endless belt 54 that has an advance side 55 and a return side 59; that will be described in more detail hereinafter.

The belt 54 (FIGS. 1A and 1B) is mounted on a plurality of rollers as follows. Starting in FIG. 1B, the belt 54 is moved around roller 56, past roller 58, around tension roller 60, past roller 84, around roller 62, past roller 64, around roller 66, past roller 68, and back to roller 56. Essentially, the advance side 55 of belt 54 is used to receive bills from the cassette 12 and from the cassette 14, and to advance these bills to a decision or a diversion point designated generally as 70 in FIG. 1A.

The means for supplying the bills 18 to the advance side 55 of the belt 54 includes the endless belts 72 (FIG. 1B) and 74 (FIGS. 1A and 1B) along with the wheels 20 and 22 associated with the cassette 12. Endless belt 72 passes around roller 76, around roller 78, and returns to roller 76 to move in the direction of arrow 80. Endless belt 74 is moved around roller 82, around roller 84, past roller 62, around one side of roller 86, around roller 88, around the opposite side of roller 86, around roller 90, past roller 92, and back to roller 82 to also move in the direction of arrow 80.

Figure 2:
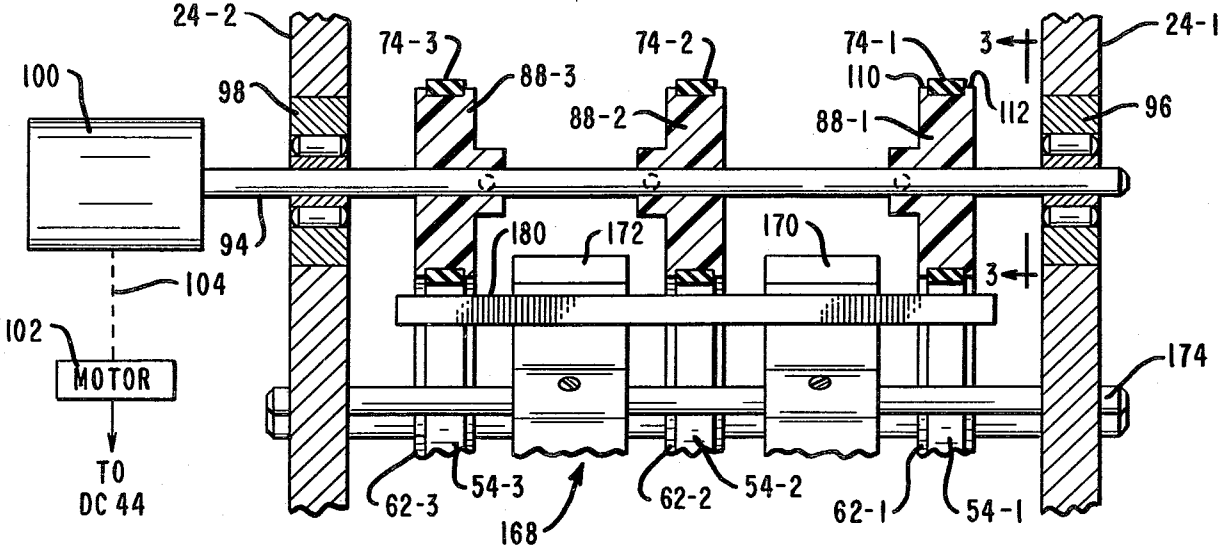
FIG. 2 is a view, taken along line 2—2 of FIG. 1A, partly in cross section, to show additional details of the belt systems used and a diverter.

The actual construction of the belts 54, 72, and 74, and the rollers 56 and 88, for example, can best be described in relation to FIG. 2. Because the construction of belts 54, 72, and 74 is similar, a description of only belt 74 will be made in detail.

While endless belt 74 has been referred to as a single belt in FIGS. 1A and 1B, it is actually comprised of three belts 74-1, 74-2, and 74-3 as shown in FIG. 2. Similarly, while roller 88, for example, has been referred to as a single roller in FIG. 1A, there are actually three rollers 88-1, 88-2, and 88-3 used in the contruction as shown in FIG. 2. Each of the rollers 88-1, 88-2, and 88-3 is pinned to the shaft 94, in spaced relation to one another as shown, to rotate therewith. The shaft 94 is rotatably mounted in bearings 96 and 98 which are mounted in frame members 24-1 and 24-2 which are shown only schematically as frame 24 in FIG. 1B. The shaft 94 is constrained from axial movement with regard to the bearings 96 and 98 by suitable "C" washers fitting into recesses in the shaft 96, none of which are shown in FIG. 2. One end of shaft 94 has a drive pulley 100 thereon which is drivingly connected to motor 102 by a suitable driving belt (shown only as dashed line 104) to rotate the rollers like 88-1 in the direction of arrow 105 shown in FIG. 1A.

Figure 3:
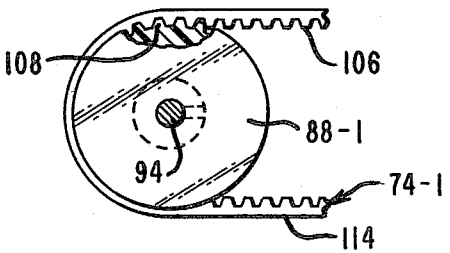
FIG. 3 is a side view, partly in cross section, and is taken along the line 3—3 of FIG. 2.

The belts 74-1, 74-2, and 74-3, shown in FIG. 2, are of the timing-belt variety as shown in FIG. 3. These belts like 74-1 are flexible and have gear teeth 106 on one side thereof which mesh with mating teeth 108 on the roller 88-1 to provide a non-slipping, driving connection therebetween. The rollers like 88-1 have peripheral flanges or shoulders like 110 and 112 extending from the teeth 108 to restrain the associated belt like 74-1 therebetween as is best shown in FIG. 2. The belts like 74-1 also have a flat side like 114 shown in FIG. 3, which flat side engages a bill like 18 when it is transported between adjacent belts like 72 and 74 shown in FIG. 1B. When moved between belts like 72 and 74, the length of a bill 18 is positioned along the length of shaft 94.

Some additional comments with regard to the rollers 88, 82, and 76, for example, shown in FIGS. 1A and 1B are as follows. For each endless belt like 74, there are driving rollers like 88-1, 88-2, and 88-3 which drive the entire endless belt 74. For endless belt 72, roller 76 may be selected as the driving roller, and similarly, for endless belt 54, roller 56 (FIG. 1B) may be selected as the driving roller. While rollers 76 and 56 are shown as single rollers, the actual construction of them is identical to rollers 88-1, 88-2 and 88-3 shown in FIG. 2. A driving shaft 118 (FIG. 1B) rotates roller 56 in the direction shown, and similarly, a driving shaft 120 rotates roller 76 in the direction shown. The driving shafts 118 and 120 are mounted in the frame members 24-1 and 24-2 as was done with shaft 94 shown in FIG. 2, and similarly, driving shafts 118 and 120 are rotated by motor 102 by conventional driving connections (not shown). Rollers 56, 76, and 88 are all identical and are rotated at a constant, rotational velocity so as to enable a bill 18 to be transported at a constant velocity and without skewing through the apparatus 10. Certain rollers such as 58, 62 and 84 are shown as having diameters which are larger than rollers 56 and 76, for example; however, they are identical in construction to the rollers like 88-1 in FIG. 2 already described. Certain rollers like 92 (FIG. 1B) for example, perform the function of a tension roller to maintain the associated endless belt like 74 in the proper tension. While roller 92 engages the flat side like 114 of belt 74, it is not necessary that it also drive the belt 74 because sufficient drive is provided by rollers 88-1, 88-2, and 88-3 as previously described.

The means for supplying the bills like 18 and 134 to the advance side 55 of endless belt 54 also includes the endless belt 124 (FIG. 1B) which travels around roller 126, around roller 58, around roller 128 and around tension roller 130 to return to roller 126. The roller 126 may be considered the drive roller and is constructed in the same manner as discussed in relation to FIG. 2.

Because the drive rollers 56, 126, 76, and 88 (FIGS. 1A and 1B) are all of the same diameter, the associated endless belts 54, 124, 72, and 74, respectively, are all driven at the same linear speed so as to transport the bills like 18 and 134 at a constant velocity therebetween. Some of the rollers like 58, 84, and 62 have diameters which are larger than the diameters of the drive rollers like 56, for example; however, because the larger rollers are not driven but freely rotate, they can rotate at a rotational velocity dictated by the linear velocity of the associated belt passing thereby. The roller 84, for example, is made larger than the drive roller 88 to provide space for the rollers 78, 128 and a transfer guide 132; this guide is used to transfer the bills being transported between endless belts 72 and 74 to endless belts 54 and 74.

The means for transporting the bills to the advance side 56 of the endless belt 54 (FIG. 1B) also includes means for supplying a second record medium or bill 134 to the advance side 56 of the endless belt 54. The bills 134 are stored in the cassette 14. A picker 136, identical to picker 16, is used to pick a bill 134 from the cassette 14 upon command of the DC 44 and transfer it to the singulating wheels 138 and 140. Wheel 138 is driven by a conventional clutch mechanism 142, and similarly, wheel 140 is driven by the clutch mechanism 144. Clutch mechanisms 142 and 144 are controlled by the DC 44 and are energized thereby. The picker 136, the clutch mechanisms 142 and 144, and the singulating wheels 138 and 140 all operate in a manner which is identical to that previously explained with regard to the corresponding elements associated with cassette 12. A bill 134, which is picked from the cassette 14, passes through the singulating wheels 138 and 140 and is transferred to the endless belts 54 and 124 at an entry point (shown by arrow 146) to be transported therebetween. A source of light 148 and an associated photodetector 150 are located near the entry point 146 to detect the presence of a bill 134 passing between belts 124 and 54. The output of the photodetector 150 is utilized by the DC 44 to de-energize the picker 136 and the clutch mechanisms 142 and 144 to stop any further feeding of bills 134 to the stripper wheels 138 and 140 until instructed to do so by the DC 44.

A bill 134 (FIG. 1B), which is fed between the endless belts 54 and 124, travels around the roller 58 and past the guide 132; it is then transferred to endless belt 54 and endless belt 74. The bill 134 is then fed around roller 62 until it reaches the diversion point 70. At this point 70, a decision is made by the DC 44 as to whether to dispense the bill to the customer or to divert it to a reject bin 152 within the apparatus 10, as will be described hereinafter. Notice that the portions of the endless belts 54 and 74 that are located between the roller 84 and the diversion point 70 provide a common transport section for bills 18 coming from cassette 12 and for bills 134 coming from cassette 14. This common transport section is provided with a conventional doubles detect sensor 154 that examines the bills 18 or 134 passing thereby and ascertains whether or not there is one bill being transported or two or more bills being transported thereby. The output of the sensor 154 is fed to the DC 44 which determines whether or not to dispense the affected bill or bills to a customer or divert it to the reject bin 152.

For the moment, it is sufficient to state that if a bill is to be dispensed to a customer, it is collected first in a stacker or buncher designated generally as 156, and if it is to be diverted, it is diverted downwardly (as viewed in FIG. 1A) to be directed to an entrance area shown by arrow 158. A bill that is positioned at the entrance area 158 will be transported by the return side 59 of the endless belt 54 and by another endless belt 160 to the reject bin 152.

The endless belt 160 (FIGS. 1A and 1B) travels around drive roller 162 (driven in a clockwise direction as viewed in FIG. 1A) around roller 64, past roller 66 around roller 164, and past tension roller 166, and thereafter it returns to drive roller 162. The drive roller 162 is operatively connected to the motor 102 (FIG. 2) by conventional means (not shown) to move the endless belt 160 at the same linear velocity as endless belt 54 is moved. The construction of the endless belt 160 and its associated rollers like 162 and 164, for example, is identical to that explained already with regard to FIG. 2.

At the diversion point 70 in FIG. 1A, there is located a diverter gate designated generally as 168 whose function has been alluded to earlier herein. The diverter gate 168 includes two fingers 170 and 172 which are shown more clearly in FIG. 2. The fingers 170 and 172 are fixed to a rod 174 which is rotatably mounted in the side frames 24-1 and 24-2 and restrained against axial movement therein. The fingers 170 and 172 are adjustably fixed to the rod 174 to lie between the individual endless belts 74-1, 74-2, and 74-3 as shown in FIG. 2, and also to lie between the endless belts 54-1, 54-2, and 54-3 which comprise endless belt 54 shown schematically in FIGS. 1A and 1B. Similarly, roller 62 shown in FIG. 1A is comprised of rollers 62-1, 62-2, and 62-3 shown in FIG. 2. The fingers 170 and 172 are biased in a counterclockwise direction (as viewed in FIG. 1A) by a tension spring 176, causing these fingers to be displaced from the position shown. In the displaced position mentioned, the fingers 172 and 174 are moved closer to roller 86, as viewed in FIG. 1A, causing any bill 18 or 134 that arrives at the diversion point 70 to be diverted downwardly to the entrance area 158 to be subsequently moved to the reject bin 152. Only when the DC 44 wishes a bill to be dispensed will a conventional actuator 178 be energized, causing the diverter gate 168 to rotate in a clockwise direction (against the bias of spring 176) to the position shown in FIG. 1A. From this position, the diverter gate 168 directs a bill 18 over the plate 180 towards the buncher 156.

The buncher 156 (FIG. 1A) collects the bills like 18 and 134 after they pass over the plate 180. After the number of bills satisfying the monetary amount requested by the control unit 30 is collected at the buncher 156, and assuming that everything is correct, the buncher 156 will deposit the stack of bills in a customer access receptacle 182. The DC 44 will then energize the actuator 184 to move or open the door 186 permitting the user to reach in through an opening 188 in the protective panel 190 of the apparatus 10 to obtain the bills 18 and 134 in the receptacle 182. If for some reason, such as a possible miscount or a cancellation of the transaction by the user, the bills are not to go to the user, the DC 44 will cause the buncher 156 to discharge or release the bills stacked thereat into the entrance area 158 from where they will be transferred to the reject bin 152 by the endless belts 54 and 160 as previously described.

Figure 4:
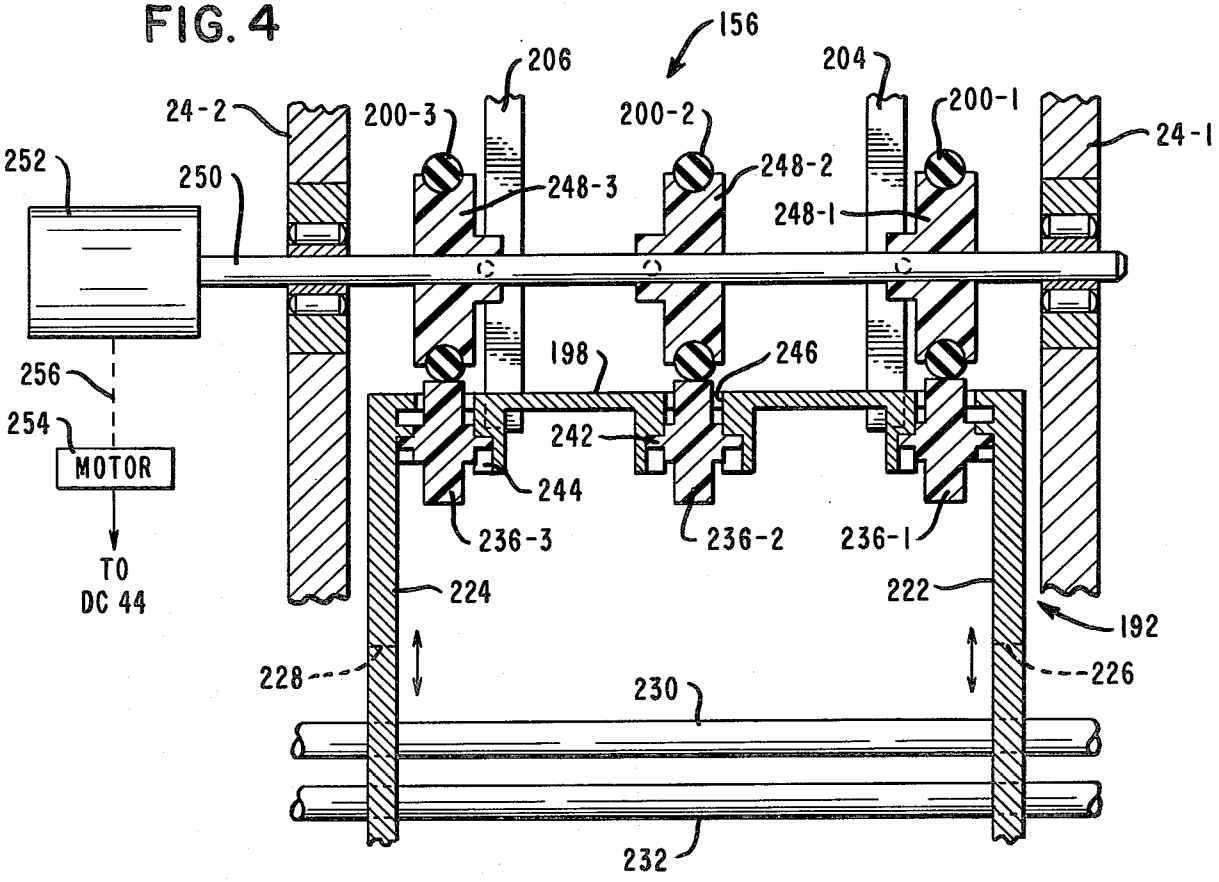
FIG. 4 is a view in elevation, partly in cross section, and is taken along the line 4—4 of FIG. 1A.

The buncher 156 (FIG. 1A) is shown in more detail in FIG. 4. The buncher 156 includes a plate assembly designated generally as 192, and this assembly is biased to the position shown in solid outline in FIG. 1A by a tension spring 194. When the buncher 156 is to receive bills approaching the diverter gate 168, the DC 44 energizes a conventional actuator 196 which moves the plate assembly 192 downwardly (as viewed in FIG. 1A) against the bias of spring 194 so that the plate 198, which is part of the plate assembly 192, is moved to the open position shown in dashed outline as 198'. When in this open position, the plate 198' and the endless belt 200 receive the bills 18 and 134 therebetween.

The buncher 156 (FIGS. 1A and 4) also includes a moveable stop designated generally as 202, and it has spaced fingers 204 and 206 which pass through suitable openings in the plate 198 to provide a stop against which the bills 18 and 134 abut when the plate 198 is in the open position shown by dashed outline 198'. The moveable stop 202 may be in the shape of an inverted "U"-shaped member, with the associated fingers 204 and 206 being spaced as shown in FIG. 4 to enable the leading edge of the length of a bill like 18 or 134 to abut thereagainst. The fingers 204 and 206 are not shown as passing through the plate 198 in an effort to simplify the drawing. The moveable stop 202 has elongated slots like slot 208 (FIG. 1A) therein with stationary rods 210 and 212 passing therethrough to enable the moveable stop 202 to be reciprocated as shown by arrows 214. The moveable stop 202 is held in the bill-abutting position shown in FIG. 1A by a tension spring 216, and it is moved to a non-abutting position when the DC 44 energizes the conventional actuator 218. When actuator 218 is energized, it pivots the lever 220 (which is operatively coupled to the moveable stop 202) in a clockwise direction, as viewed in FIG. 1A, to move the stop 202 upwardly to withdraw the fingers 204 and 206 out of the plate 198. With the fingers 204 and 206 withdrawn, bills like 18 and 134 which are stacked within the buncher 156 may be delivered or released to the customer access receptacle 182.

The plate assembly 192 (FIGS. 1A and 4) has planar members 222 and 224 which depend from the underside of plate 198. The planar members 222 and 224 have elongated slots 226 and 228, respectively, therein to receive the stationary rods 230 and 232 to enable the plate assembly 192 to be reciprocated along the directions of arrows 234 to enable the plate 198 to assume the positions shown in FIG. 1A. The ends of the rods 230 and 232 are secured detachably to the frame members. 24-1 and 24-2.

The plate 198 rotatably supports three sets of wheels 236, 238, and 240 shown in FIG. 1A. The set of wheels 236, for example, is comprised of the wheels 236-1, 236-2, and 236-3 shown in FIG. 4. Each wheel like 236-3 has axles 242 extending therefrom to rotatably support the associated wheel in a conventional, snap-in recess 244 formed in the underside of plate 198 as viewed in FIG. 4. The plate 198 has holes therein like 246 to enable the periphery of the associated wheel like 236-2 to pass therethrough and to rise above the plate 198 as shown in FIG. 4.

The endless belt 200, shown only schematically in FIG. 1A, is shown in more detail in FIG. 4. The belt 200 is comprised of belts 200-1, 200-2, and 200-3 which are of the elastic or rubber "O"-ring type. The drive roller 248, shown only schematically in FIG. 1A, is comprised of the spaced, drive rollers 248-1, 248-2, and 248-3 as shown in FIG. 4, with each of these drive rollers being secured to a drive shaft 250 to be rotated thereby. The drive shaft 250 is rotatably mounted in the frame members 24-1 and 24-2 and is restrained against axial movement therein by suitable "C"-type washers (not shown). The shaft 250 also has a drive pulley 252 on one end thereof which is operatively connected to a conventional, bi-directional motor 254 by conventional coupling means 256.

Each of the drive rollers 248-1, 248-2, and 248-3 has an annular recess formed around-its periphery to receive the associated endless belt 200-1, 200-2, and 200-3, respectively. The drive roller 256, shown schematically in FIG. 1A, is also comprised of three rollers 256-1, 256-2, and 256-3 which are not shown but are identical to the drive rollers like 248-1, for example, which are shown in FIG. 4A. The endless belts 200-1, 200-2, and 200-3, which are rubber-like, are simply stretched slightly to mount them on their associated rollers, as for example, belt 200-1 is mounted on drive roller 248-1 and roller 256-1.

When a user of the apparatus 10 wishes to withdraw an amount of currency therefrom, he enters certain coded data on the keyboard and performs certain other functions (not important to this invention) to establish that he is a valid user of the machine. He then enters the amount of currency that he wishes to withdraw therefrom. The dispenser control 44 then determines the amount of bills 18 to be dispensed (if any) from cassette 12 and the amount of bills 134 to be dispensed (if any) from cassette 14.

Assuming that bills 18 and bills 134 are to be dispensed to provide the amount of currency requested by a user of the apparatus 10, the following sequences occur. The motor 102 (FIG. 2) is energized to start moving all the endless belts 54, 124, 72, 74, and 160 mentioned. Assuming also that the bills 18 are to be dispensed first, the DC 44 then energizes the picker 16 to transfer a bill 18 from the cassette 12 to a position above the singulating wheels 20 and 22 that would be rotating due to their associated clutches 26 and 28, respectively, being energized by the DC 44. A bill 18 passing between the wheels 20 and 22 is transferred to the endless belts 72 and 74 from the position shown by arrow 258. A light source 260 and an associated photodetector 262 detect the leading edge of a bill 18 passing therebetween, and the resulting signal is used by the DC 44 to turn off the clutches 26 and 28 until another request for a bill is made by the DC 44. The bill 18 is then transferred between belts 72 and 74 around guide 132, at which point, the bill 18 is transferred between belts 54 and 74. The doubles detect sensor 154 then examines the "bill" 18 passing thereby to determine whether or not a double bill exists. If the indication from sensor 154 to the DC 44 is that a "single" bill 18 exists, the DC 44 then energizes actuator 178 (FIG. 1A) to move the diverter gate 168 to the position shown to enable the bill to pass over plate 180 towards the buncher 156. The DC 44 would also have energized the actuator 196 (FIG. 1A) by this time to lower the plate 198 to enable the buncher 156 to receive bills thereat. A sensor shown only as a block 266 in FIG. 1A includes a light source and an associated photodetector. The sensor 266 is used to inform the DC 44 that a bill like 18 is in fact being transferred to the buncher 156. A bill leaving the plate 180 is transferred to the buncher 156 where the leading edge of the bill 18 abuts against the fingers 204 and 206 as previously described.

If, in the example described in the previous paragraph, a "double" bill 18 is detected by doubles detect sensor 154, the output thereof is utilized by the DC 44 to reject this "double" bill 18. In this instance, the DC 44 would not energize actuator 178, leaving the diverter gate 168 in position to divert the bills downwardly to the entrance area 158 where the moving endless belts 54 and 160 accept the bills and transfer them to the reject bin 152. Thereafter, the DC 44 repeats the process of picking another bill 18 from the cassette 12 and forwarding it to the diverter gate 168 where it is forwarded to the buncher 156, assuming that it successfully passes the doubles detect sensor 154.

After the two bills 18 from the cassette 12 are stacked in the buncher 156 in the example being described, the DC 44 will then initiate the picking and transferring of two bills 134 from the cassette 14 to the buncher 156. Each bill 134 coming from the cassette 14 is transported between endless belts 54 and 124 past the guide 132, at which point the transporting is transferred to the combination of endless belts 54 and 74. Notice that this latter combination of belts 54 and 74 represents a common transporting portion which is used for transporting bills 18 from cassette 12 and bills 134 from cassette 14.

Assuming that two bills 18 from cassette 12 and two bills 134 from cassette 14 are loaded in the buncher 156 in the example being described, the DC 44 will then initiate the final dispensing of the bills 18 and 134 to a customer. To effect this, the DC 44 deenergizes the actuator 196 (FIG. 1A) permitting the spring 194 to advance the plate 198 with the bills 18 and 134 thereon towards the endless belts like 200-1 and 200-3 to grip them between the belts and the associated wheels like 236-1 and 236-3. The DC 44 then energizes actuator 218 (FIG. 1A) causing the fingers 204 and 206 to be withdrawn out of the plate 198. Thereafter, the DC 44 energizes motor 254 to rotate the drive rollers like 248-1 (in a clockwise direction as viewed in FIG. 1A) to or release the bunched bills 18 and 134 to the customer access receptacle 182. A sensor 266, shown only as a block in FIG. 1A, is utilized to detect the presence or absence of bills at the buncher 156. The outputs from sensor 266 are used by the DC 44 to verify the presence or absence of bills at the buncher 156. After the bills 18 and 134 are dropped into the receptacle 182 in the example being described, the DC 44 energizes actuator 184 to open door 186 to permit the customer access to the receptacle 182 to obtain the bills therein. After a predetermined time interval, the DC 44 will energize the actuator 184 to close the door 86.

Continuing with the example being described, if a customer wishes to cancel the entire transaction (via a keyboard 32 entry) after the bills 18 and 134 are accumulated at the buncher 156, for example, the DC 44 would then energize the motor 254 in a direction which rotates the drive wheels like 248-1 in a counterclockwise direction as viewed in FIG. 1A. The bills in the buncher 156 would then be deposited in the entrance area 158 from which they would be transported by the endless belts 54 and 160 to the reject bin 152 which is not accessible to a customer.

We claim:

1. A record media transporting mechanism comprising:

a first moving endless belt system having an advance side and a return side and also having a diversion point therebetween;

means for supplying record media to said advance side and also for cooperating with said advance side to transfer said record media to said diversion point;

a second moving endless belt system cooperating with said return side to provide an entry area and a discharge area with regard to said record media and also for transporting record media from said entry area to said discharge area;

a customer access receptacle; means for receiving and accumulating said record media received from said diversion point and also for selectively transferring said received and accumulated record media to said entry area or said customer access receptacle;

means located at said diversion point for diverting said record media into said entry area or said receiving, accumulating, and transferring means in response to a control signal; and control means for generating said control signal and also for controlling the movement of said record media in said receiving, accumulating and transporting mechanism in response to predetermined criteria.

2. A record media transporting mechanism comprising:

a first moving endless belt system having an advance side and a return side and also having a diversion point therebetween;

means for supplying record media to said advance side and also for cooperating with said advance side to transfer said record media to said diversion point;

a second moving endless belt system cooperating with said return side to provide an entry area and a discharge area with regard to said record media and also for transporting record media from said entry area to said discharge area;

means for receiving and accumulating said record media received from said diversion point;

means located at said diversion point for diverting said record media into said entry area or said receiving accumulating means in response to a control signal; and control means for generating said control signal and also for controlling the movement of said record media in said transporting mechanism in response to predetermined criteria;

said supplying means comprising:

first feed means for supplying record media of a first type to said advance side;

second feed means located upstream with regard to said first feed means for supplying record media of a second type to said advance side; and detector means located upstream from said diversion point and being coupled to said control means for detecting overlapping or superposed record media coming from said first and second feed means to enable said diverting means to divert said record media into said entry area upon detecting overlapping or superposed record media; and said receiving and accumulating means comprising:

a receiving unit and means for moving said receiving unit between document receiving and document releasing positions;

a stop member and means for moving said stop member between blocking and non-blocking positions with regard to said receiving unit in response to said control means so as to provide a stop against which said record media may be accumulated when said receiving unit is in said document receiving position and said stop member is in said blocking position.

3. The transporting mechanism as claimed in claim 2 in which said receiving unit has at least one hole therein through which said stop member passes when it is in said blocking position.

4. The transporting mechanism as claimed in claim 3 in which said advance side of said first moving endless belt system is substantially vertical and said return side is substantially parallel to said advance side and is spaced therefrom.

5. The transporting mechanism as claimed in claim 4 in which said receiving and accumulating means comprises:

a receiving unit and means for moving said receiving unit between document receiving and document releasing positions;

a stop member and means for moving said stop member between blocking and non-blocking positions with regard to said receiving unit in response to said control means so as to provide a stop against which said record media may be accumulated when said receiving unit is in said document receiving position and said stop member is in said blocking position.

6. A record media transporting mechanism comprising:

a first moving endless belt system having an advance side and a return side and also having a diversion point therebetween;

means for supplying record media to said advance side and also for cooperating with said advance side to transfer said record media to said diversion point;

a second moving endless belt system cooperating with said return side to provide an entry area and a discharge area with regard to said record media and also for transporting record media from said entry area to said discharge area;

means for receiving and accumulating said record media received from said diversion point;

means located at said diversion point for diverting said record media into said entry area or said receiving and accumulating means in response to a control signal; and control means for generating said control signal and also for controlling the movement of said record media in said transporting mechanism in response to predetermined criteria;

said supplying means comprising:

first feed means for supplying record media of a first type to said advance side;

second feed means located upstream with regard to said first feed means for supplying record media of a second type to said advance side; and detector means located upstream from said diversion point and being coupled to said control means for detecting overlapping or superposed record media coming from said first and second feed means to enable said diverting means to divert said record media into said entry area upon detecting overlapping or superposed record media;

said receiving and accumulating means comprising:

a receiving unit and means for moving said receiving unit between document receiving and document releasing positions;

a stop member and means for moving said stop member between blocking and non-blocking positions with regard to said receiving unit in response to said control means so as to provide a stop against which said record media may be accumulated when said receiving unit is in said document receiving position and said stop member is in said blocking position; and bi-directional drive means under the control of said control means to move the record media which may be accumulated at said receiving unit to said entry area after said receiving unit is moved to said document releasing position upon a first signal to said bi-directional drive means from said control means, and also to move the record media which may be accumulated at said receiving unit to a customer access receptacle after said stop member is moved to said non-blocking position and upon the occurrence of a second signal to said bi-directional drive means from said control means.

7. The transporting mechanism as claimed in claim 6 in which said bi-directional drive means includes an endless conveyor belt means for engaging said record media which are accumulated on said receiving unit when said receiving unit is in said document releasing position, and also includes means for moving said endless conveyor belt means bi-directionally.

8. The transporting mechanism as claimed in claim 7 in which said receiving unit is generally planar in shape and said means for moving said receiving unit includes a resilient member for biasing said receiving unit towards said document releasing position and also includes an actuator under the control of said control means for moving said receiving unit to said document receiving position in which said receiving unit is spaced from said endless conveyor belt means.

9. The transporting mechanism as claimed in claim 8 in which said advance side of said first moving endless belt system is substantially vertical and said return side is substantially parallel to said advance side and is spaced therefrom.

10. The transporting mechanism as claimed in claim 9 in which said first moving endless belt system also includes a guideplate which is located downstream from said diversion point to direct record media to said receiving and accumulating means.

* * * * *